US007517271B1

(12) United States Patent
Alfaro

(10) Patent No.: US 7,517,271 B1
(45) Date of Patent: Apr. 14, 2009

(54) CONTROL SYSTEM FOR A PUPPET

(76) Inventor: Albert Alfaro, 410 Norton Rd., Stroudsburg, PA (US) 18360

( * ) Notice: Subject to any disclaimer, the term of this patent is extended or adjusted under 35 U.S.C. 154(b) by 470 days.

(21) Appl. No.: 11/247,154

(22) Filed: Oct. 12, 2005

(51) Int. Cl.
*A63H 3/20* (2006.01)

(52) U.S. Cl. ..... 446/359; 446/366; 446/361; 446/266; 40/411; 40/416; 40/418

(58) Field of Classification Search ..... 446/266, 446/217, 218, 236, 239, 246, 359–368, 314, 446/489, 330, 352, 353; 40/411, 416, 418
See application file for complete search history.

(56) References Cited

U.S. PATENT DOCUMENTS

| | | | | | |
|---|---|---|---|---|---|
| 1,784,183 | A | * | 12/1930 | Fike | 446/333 |
| 2,351,510 | A | * | 6/1944 | Harless | 446/29 |
| 2,489,107 | A | * | 11/1949 | Rheingold et al. | 446/266 |
| 3,390,481 | A | | 7/1968 | Runanin | |
| 3,570,173 | A | * | 3/1971 | Case | 446/365 |
| 4,244,138 | A | * | 1/1981 | Holahan et al. | 446/301 |
| 4,656,770 | A | * | 4/1987 | Nuttle | 43/2 |
| 4,815,911 | A | * | 3/1989 | Bengtsson et al. | 414/7 |
| 4,986,791 | A | | 1/1991 | Alfaro | |
| 5,289,273 | A | * | 2/1994 | Lang | 348/121 |
| 5,498,193 | A | | 3/1996 | Locricchio | |
| 6,142,851 | A | * | 11/2000 | Lewinski et al. | 446/278 |
| 6,439,952 | B1 | * | 8/2002 | Yamamura | 446/383 |
| 6,675,522 | B2 | * | 1/2004 | Mathews | 43/3 |
| 6,773,327 | B1 | * | 8/2004 | Felice et al. | 446/330 |
| 6,827,626 | B1 | | 12/2004 | Feeney et al. | |
| 6,939,196 | B2 | * | 9/2005 | Bellon | 446/366 |
| 2006/0183402 | A1 | * | 8/2006 | von Jabba | 446/359 |

FOREIGN PATENT DOCUMENTS

GB 2232899 A * 1/1991

* cited by examiner

*Primary Examiner*—Gene Kim
*Assistant Examiner*—Urszula M Cegielnik
(74) *Attorney, Agent, or Firm*—Mark Levy; Hinman, Howard & Kattell

(57) ABSTRACT

There is provided a control mechanism for use with a puppet and puppets adapted for control thereby. One or more single-strand, sheathed cables are adapted for imparting motion to at least one movable part of a puppet. Both longitudinal (i.e., in-and-out) and rotary motions may be imparted to the cables, thereby allowing a wide range of resulting movements of the attached puppet part. In one embodiment, longitudinal movement of the cable strand imparts a flapping motion to the wings of a puppet while rotary motion of the same cable imparts a wagging motion to the puppet's tail. Regardless of whether one or two cables are used, the actuation of the cables may be performed discreetly and out of view of the audience of the puppeteer's show.

7 Claims, 7 Drawing Sheets

CONTROL SYSTEM FOR A PUPPET

RELATED APPLICATIONS

The present invention is related to U.S. Pat. No. 4,986,719 for PUPPET, issued Jan. 22, 1991, included herein in its entirety by reference.

FIELD OF THE INVENTION

The invention pertains to puppets and, more particularly, to a puppet having a control system for imparting realistic movements to a head, wings, or tail thereof.

BACKGROUND OF THE INVENTION

Puppeteers often utilize puppets placed on or near the bodies, for example, for use as a ventriloquist's dummy. In such situations, it is desirable to discreetly impart movement to portions of the puppet perched, for example, on the shoulder of the puppeteer. Many mechanisms have been developed to accomplish this purpose, such as solid rods attached to the head of a puppet, etc. None of the methods of the prior art provides realistic movements using a mechanism discreetly operable by the puppeteer.

DISCUSSION OF THE RELATED ART

U.S. Pat. No. 3,390,481 for PUPPET AND ANIMATION DEVICES, issued Jul. 2, 1961 to Boris Runanin provides a complex actuation mechanism using pulleys in cooperation with other mechanisms to motivate a puppet. The RUNANIN puppet is not adapted for placement on or near the body of a puppeteer and the complex mechanism provided could not be easily adapted for discrete operation of a puppet.

U.S. Pat. No. 4,986,791 for PUPPET, issued Jan. 22, 1991 to Albert Alfaro shows a mechanism wherein a sheathed cable is used to actuate the head of a shoulder-sitting puppet.

U.S. Pat. No. 5,498,193 for MANUALLY ACTUATED TOY DINOSAUR STRUCTURE AND METHOD, issued Mar. 12, 1996 to Salvatore Locricchio provides a figurine having movable parts remotely actuatable by a sheathed cable having plural actuating cable strands housed therewithin. Actuation is provided by a hand-held apparatus having plural triggers for imparting only linear motion to individual actuating cable strands.

U.S. Pat. No. 6,827,626 for MARIONETTE, issued Dec. 7, 2004 to Mary Jo Feeney, et al. provides a marionette having, in addition to strings, a solid actuating rod attached to the head of the marionette.

None of these patents taken singly, or in any combination, is seen to teach or suggest the puppet and actuating mechanism of the present invention.

SUMMARY OF THE INVENTION

The present invention features a unique control mechanism for use with a puppet and puppets adapted for control thereby. One or more single-strand, sheathed cables are adapted for imparting motion to at least one movable part of a puppet. Both longitudinal (i.e., in-and-out) and rotary motions may be imparted to the cable strands thereby allowing a wide range of resulting movements of the attached puppet part. In one embodiment, longitudinal movement of the cable strand imparts a flapping motion to the wings of a puppet while rotary motion of the same cable imparts a wagging motion to the puppet's tail. Regardless of whether one or two cables are used, the actuation of the cables may be performed discreetly and out of view of the audience of the puppeteer's show.

It is, therefore, an object of the invention to provide a puppet figure having at least one part movable with respect to another part.

It is an additional object of the invention to provide a puppet figure wherein a part is moved by the movement of a cable strand within a sheathed cable.

It is another object of the invention to provide a puppet figure wherein the movement of the cable strand may be both longitudinal and rotary.

It is a further object of the invention to provide a puppet figure wherein two parts may be selectively moved independently by longitudinal and rotary motion of a single cable.

It is a still further object of the invention to provide a puppet figure wherein the moved part is supported solely by the cable strand of the sheathed cable.

BRIEF DESCRIPTION OF THE DRAWINGS

A complete understanding of the present invention may be obtained by reference to the accompanying drawings, when taken in conjunction with the detail description thereof and in which.

DESCRIPTION OF THE PREFERRED EMBODIMENT

The present invention features a control system for a multi-part puppet wherein one portion of the puppet, for example a head, is supported solely by a flaccid control cable and is thereby movable independently of any other body part.

Figure 1A:
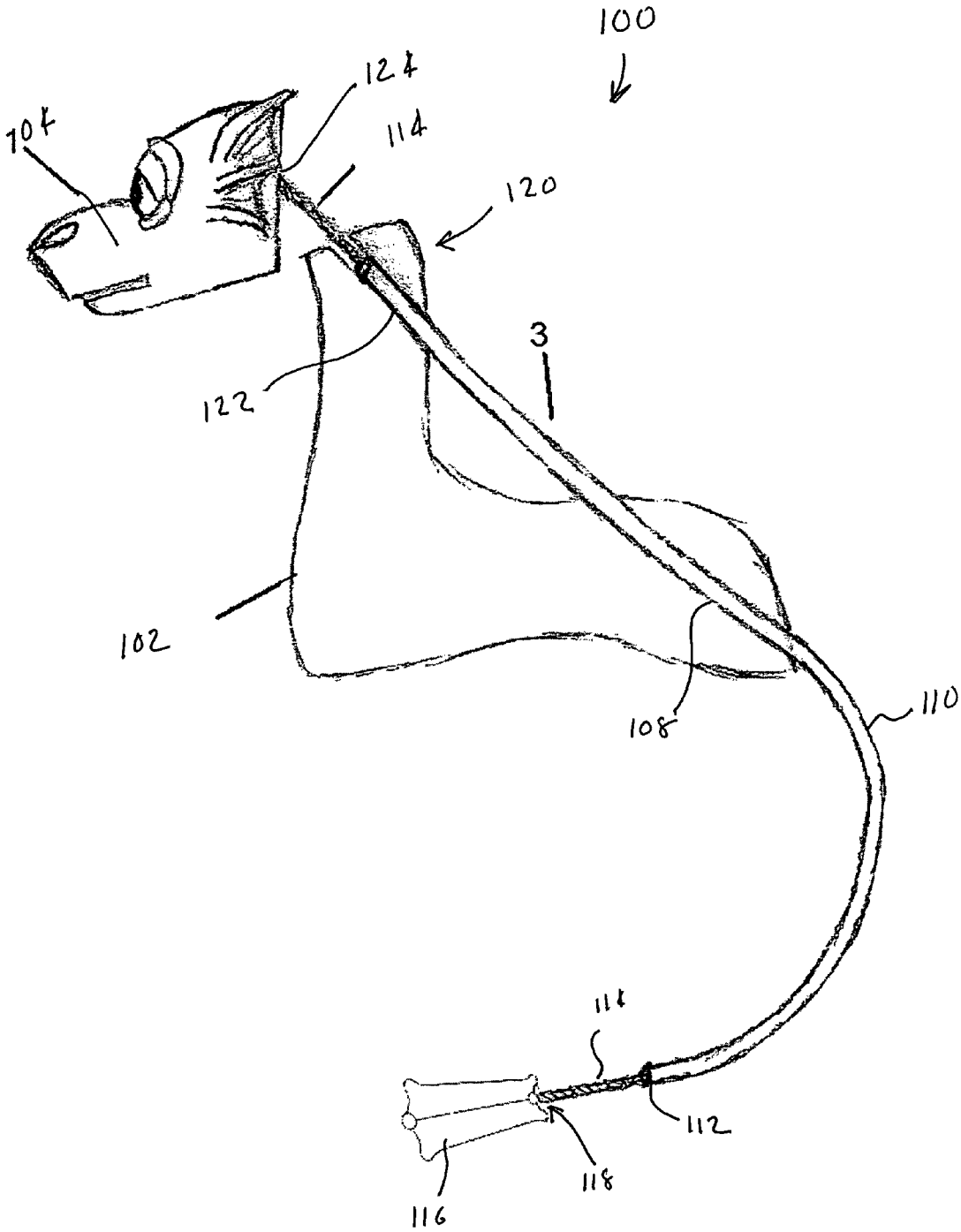
FIG. 1*a* is a side elevational view of a first embodiment of a puppet in accordance with the invention.

Referring first to FIG. 1*a*, there is shown a side elevational pictorial view of a two piece puppet, generally at reference number 100. Puppet 100 is designed to resemble a dragon. It will be recognized, however, that any other puppet shape might be substituted therefor. Consequently, the inventive puppet control system may be used with any suitable puppet shape and the invention is not considered limited to the shape chosen for purposes of disclosure.

Puppet 100 has a main body portion 102 and a head portion 104. Main body portion 102 and head portion 104 are made from polymer clay. Body portion 102 and head 104 may be formed by casting, sculpting, or any other suitable means. Body portion 102 has a posterior region 106 having a first bore 108 therethrough sized to accept the outer diameter of a cable 110. Body portion 102 has a neck portion 120 having a second bore 122 therethrough. Second bore 122 is also sized and configured to receive and secure a proximal end of a hollow outer sheath 112 of cable 110. Cable 110 has sheath 112 and a central shaft 114 disposed substantially concentrically therein. Shaft 114 is free to move both longitudinally and rotatively with respect to sheath 112. An actuator 116 is disposed at a distal end 118 of shaft 114 of cable 110.

Head 104 is securely affixed to proximal end 124 of shaft 114. Securement is typically by an adhesive. It will be recognized by those of skill in the art that other mechanical mechanisms such as clips, staples, clamps, screws, etc. may also be used to secure head 104 to shaft 114 and the invention is not limited to any particular securing method.

Typically, proximal end 124 of shaft 114 protrudes beyond second bore 122 sufficiently so that head 104 is spaced apart from body 102, thereby allowing room for movement of head 104 relative to body 102.

An inexpensive cable found useful for practicing the invention is brake control cable well known to those of skill in the bicycle arts.

In operation, an operator of puppet 100 moves head 104 by pushing, pulling, or rotating actuator 116. Because head 104 is securely affixed to proximal end 124 of shaft 114, head 104 moves up and down or around in response to movement of actuator 116. Unlike other puppet constructions of the prior art, the inventive control system, while simple in concept, provides unique motions to head 104.

Figure 1B:
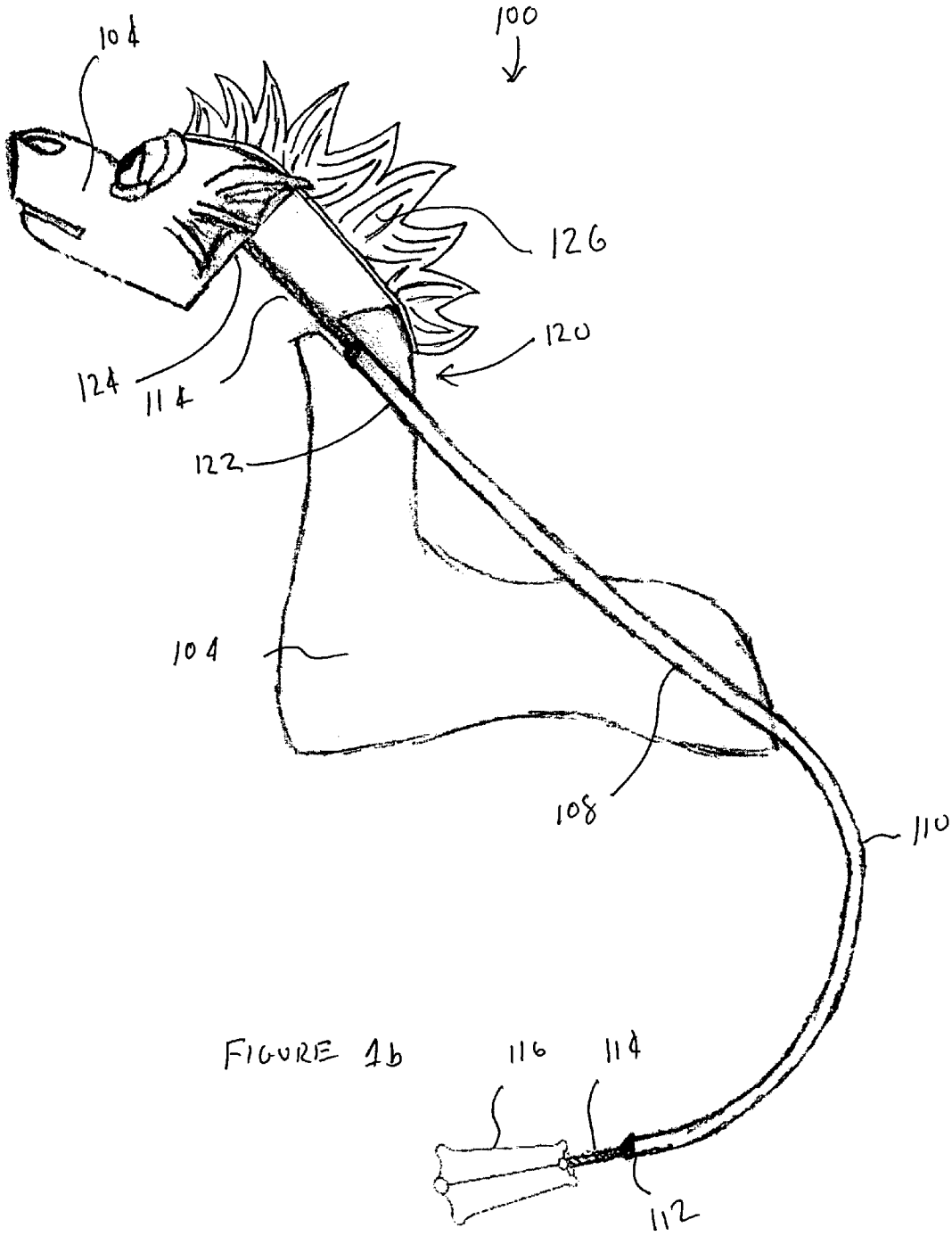
FIG. 1*b* is a side elevational view of an alternate embodiment of the puppet of FIG. 1*a;*

Referring now to FIG. 1*b*, there is shown an alternate embodiment of puppet 100 of FIG. 1*a*. Most details remain the same, but a piece of fur 126 is placed between head portion 104 and body portion 102. As head portion 104 moves, fur 126 moves responsively creating an interesting visual illusion.

Figure 2A:
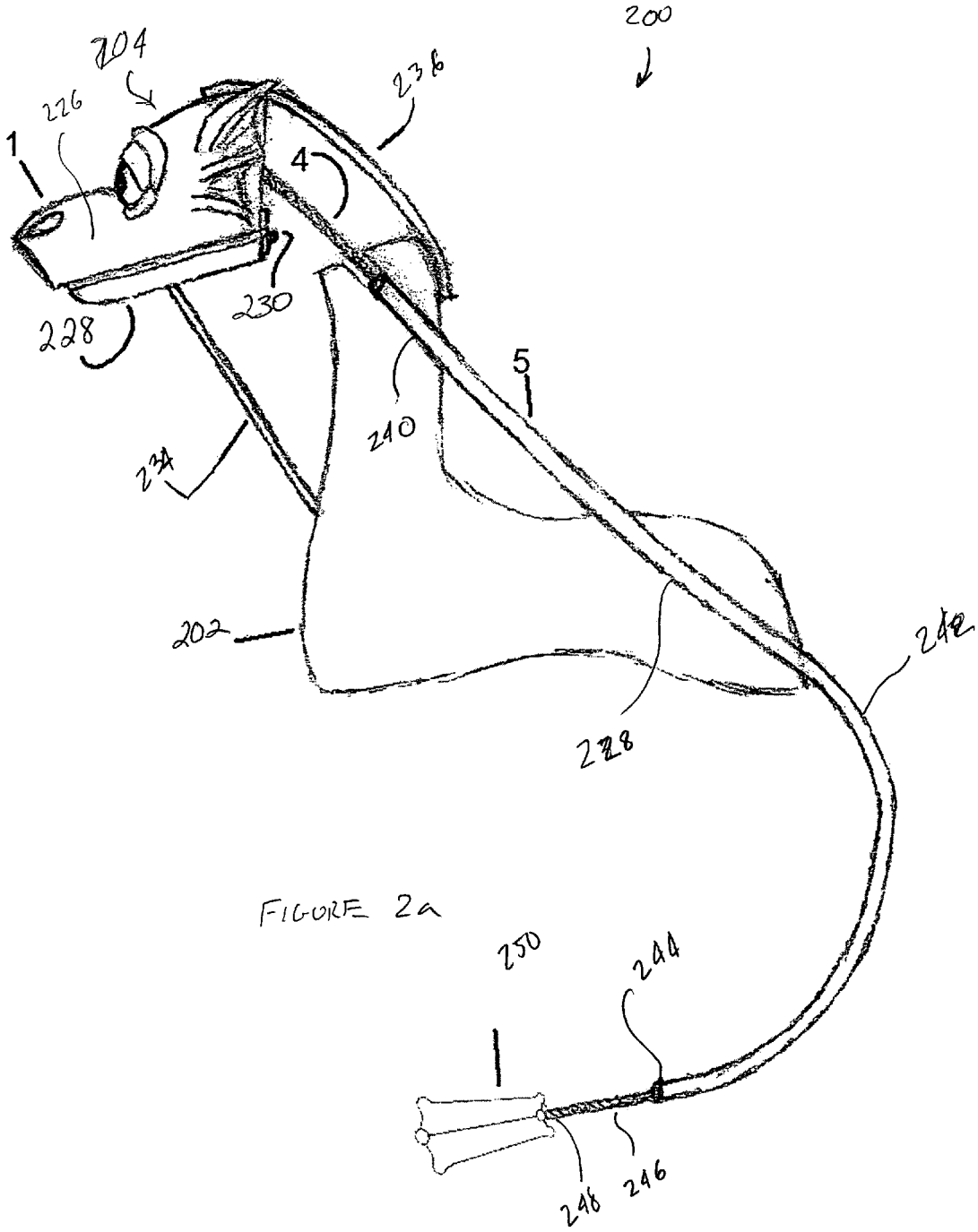
FIGS. 2*a* and 2*b* are side elevational views of a second embodiment of a puppet in mouth closed and mouth open positions, respectively.
Figure 2B:
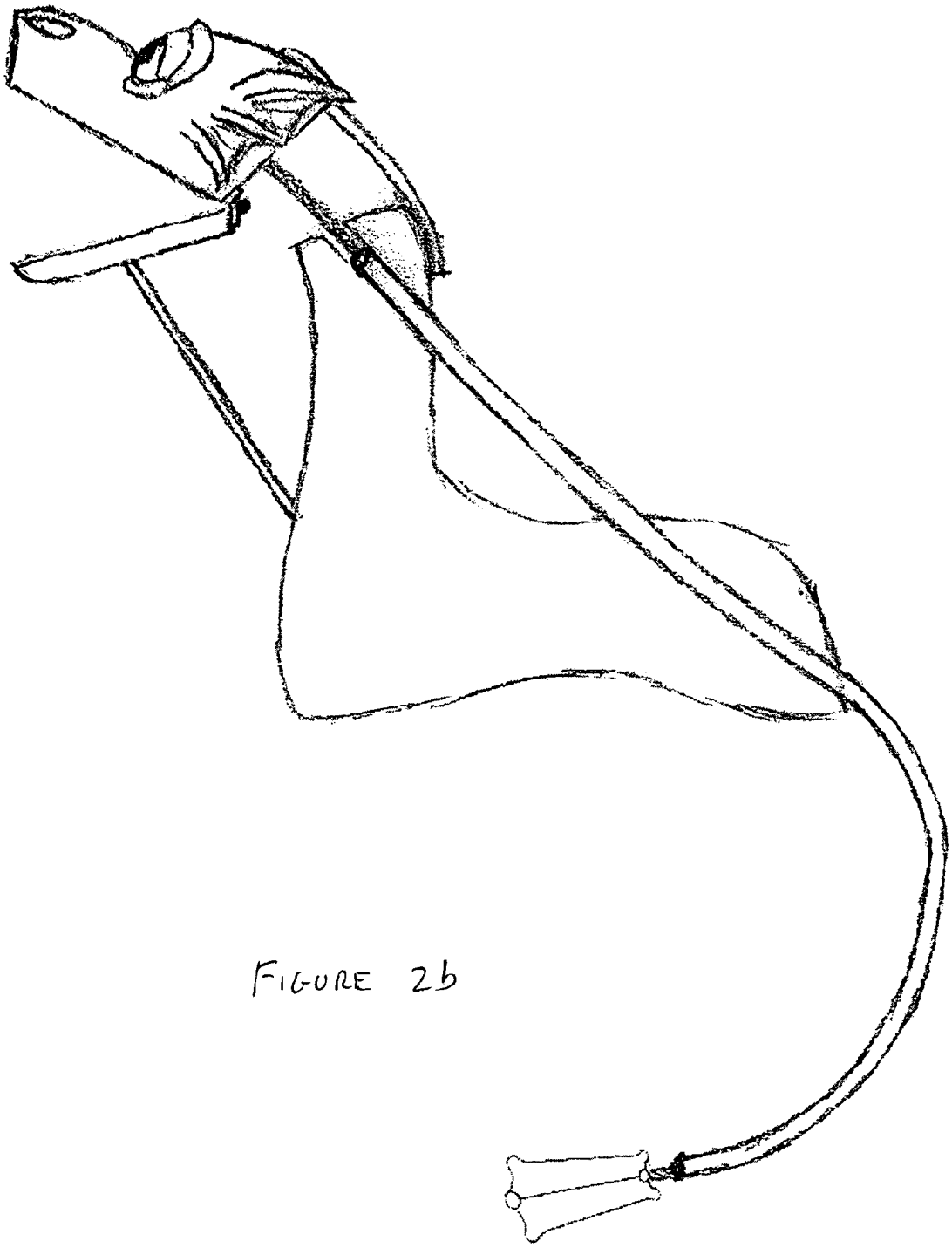
Figure 2C:
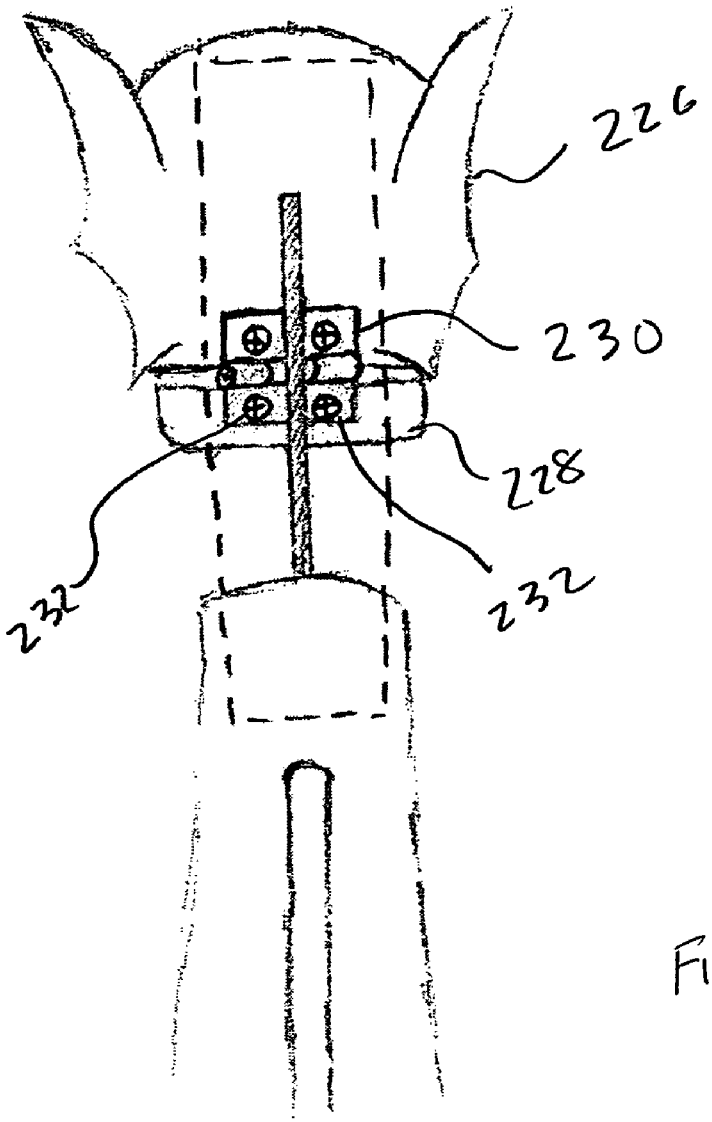
FIG. 2*c* is an enlarged schematic view of a hinge portion of the puppet of FIGS. 2*a* and 2*b;*

Referring now to FIGS. 2*a*-2*c*, there are shown side elevational pictorial views of another puppet, generally at reference number 200. FIG. 2*a* depicts puppet 200 in a closed mouth position while FIG. 2*b* depicts puppet 200 with an open mouth. FIG. 2*c* shows details of a mouth hinge 230. Puppet 200 is similar in construction to puppet 100 (FIG. 1*a*) but includes a movable mouth.

Puppet 200 has a main body portion 202 and a head portion 204, both made from polymer clay or other suitable material as discussed hereinabove. Head portion 204 consists of an upper portion 226 and a lower mouth portion 228 attached thereto by a hinge 230, best seen in FIG. 2*c*. Hinge 230 is attached to both upper mouth portion 226 and lower mouth portion 228 using screws 232 or other suitable fasteners. In alternate embodiments, hinge 230 could be adhesively affixed to one or both of upper mouth portion 226 or lower mouth portion 228. A rigid support member 234 holds lower mouth portion 228 fixed relative to body portion 202. A thin, stiff wire or other such device may be used as support member 234. A flaccid restraining member 236 is attached to upper portion 226 and to body portion 202. Flaccid restraining member 236 is preferably a piece of thin, non-elastic fabric.

As discussed hereinabove in conjunction with puppet 100 (FIG. 1), body portion 202 has both a first bore 238 and a second bore 240 adapted to receive a cable 242. Cable 242 has an outer sheath 244 and a shaft 246 disposed substantially concentrically therein. The distal end 248 of shaft 246 is equipped with an actuator 250.

In operation, inward pressure on actuator 250 causes shaft 246 to move longitudinally within sheath 244. Because lower mouth portion 228 is held in a fixed relationship to body portion 202 by rigid support member 234, the movement of head portion 204 is substantially upward as upper portion 226 rotates around a pivot, not shown, formed by hinge 230. Upward movement of head 204 is limited by flaccid restraint member 236. The motion of head 204 caused by in-and-out motion of actuator 250 creates an upward opening illusion in the motion of puppet 200. The open position of head 204 may be seen in FIG. 2*b*.

Figure 3A:
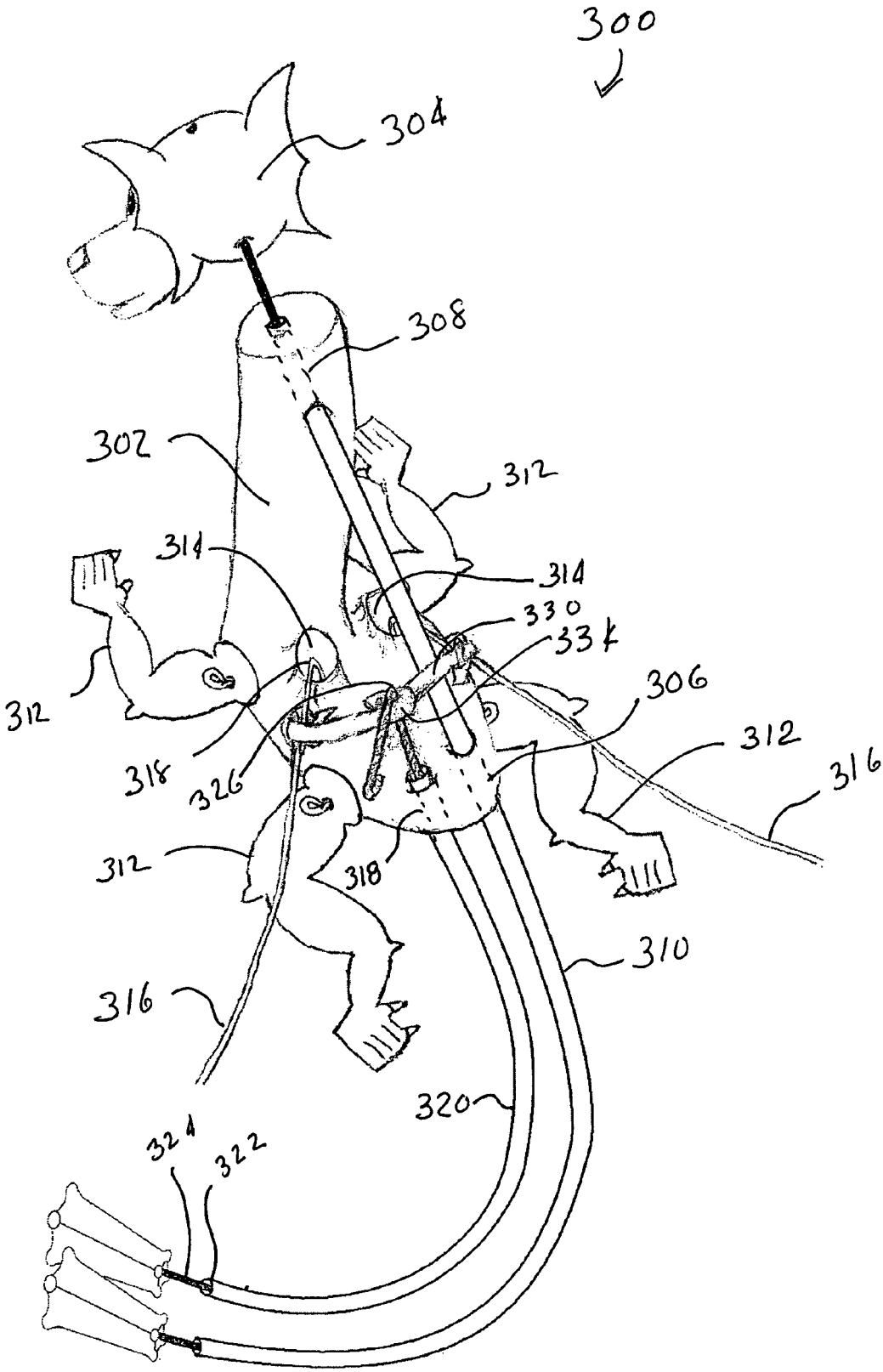
FIG. 3*a* is a rear, perspective view of a third embodiment of a puppet in accordance with the invention.
Figure 3B:
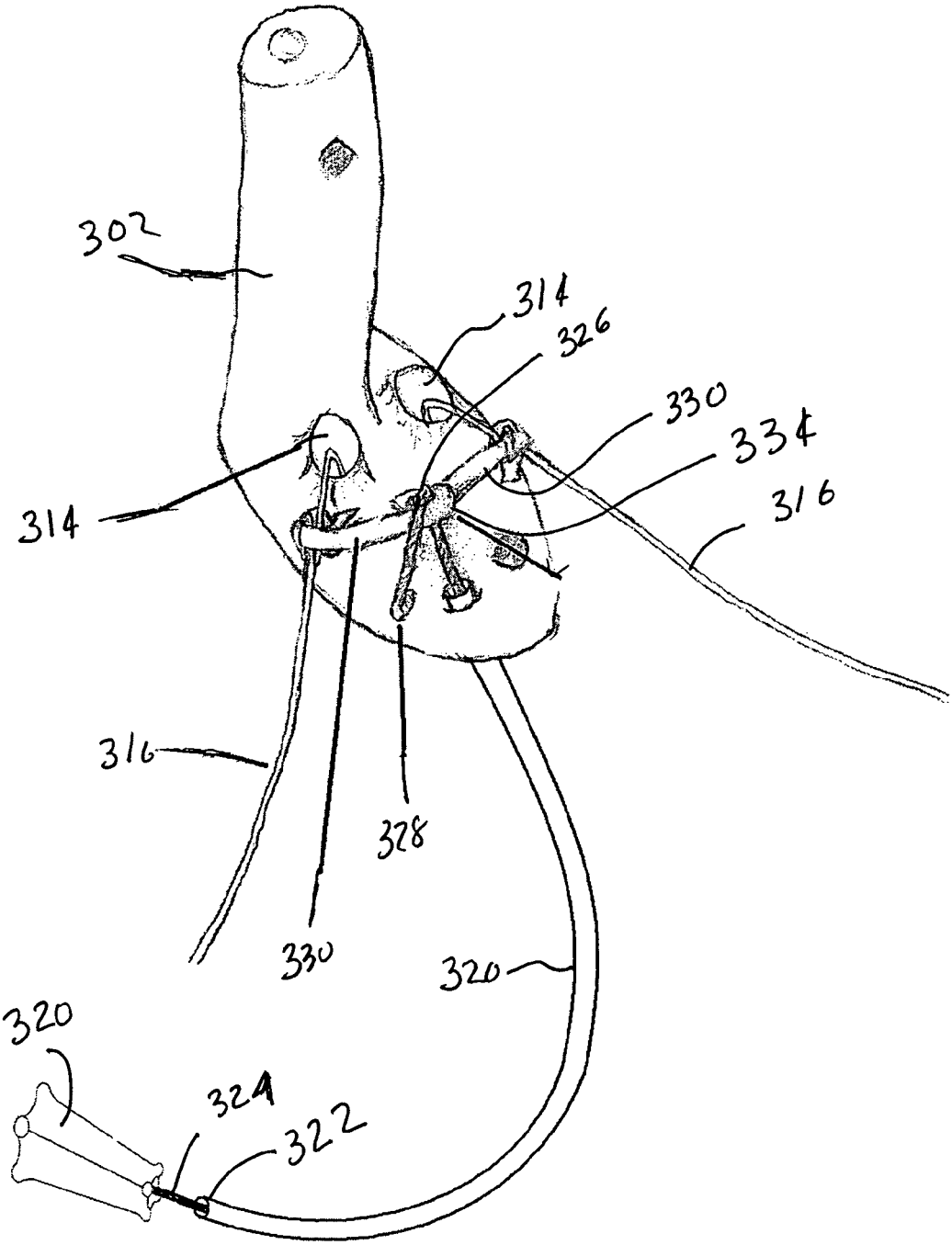
FIG. 3*b* is a detailed, schematic view of the puppet shown in FIG. 3*a*.

Referring now to FIGS. 3*a* and 3*b*, there are shown a rear perspective, pictorial view and a detailed view of a portion thereof, respectively, of a third puppet, generally at reference number 300. Puppet 300 is similar to puppets 100 and 200 (FIGS. 1 and 2*a*-2*c*, respectively) discussed hereinabove. Similar components and/or features previously described are not further described in detail. Puppet 300, however, has additional, movable appendages, described in greater detail hereinbelow. Puppet 300 has a body portion 302 and a one-piece head portion 304, similar to head portion 104 of puppet 100. While a one-piece head portion 304 is shown for purposes of disclosure, it will be recognized that puppet 300 might be provided with a two-piece head similar to head portion 204 of puppet 200 (FIG. 2*a*). As has already been described, body portion 302 has a first bore 306 a second bore 308 sized and adapted to receive a first, head control cable 310.

Four legs 312 are attached to body portion 302. Legs 312 may be fixed or movable with respect to body portion 302.

Body portion 302 has a pair of sockets 314 disposed in a central, posterior region thereof. Sockets 314 are each adapted to loosely receive the end of a wing support member 316 therein. Wing support members 316 are typically formed from stiff wire and each has a bent portion 318 formed at a proximal end thereof. Bent portion 318 may move freely within socket 314, typically experiencing three degrees of freedom of movement. Dragon wings, not shown, are typically attached to wing support members 316.

A third bore 318 formed in body portion 302 is sized and adapted to receive and retain a second cable 320. Second cable 320 has an identical construction as first head cable 310 and has an outer sheath 322 and an inner shaft 324. Sheath 322 is retained within a third bore 318. Shaft 324 extends beyond third bore 318 and has a bend 326 formed therein. A loop 328 is formed at the proximal end of shaft 324 of second cable 320. Loop 328 is configured for attachment to a tail, not shown. An actuator 320 is disposed at the distal end of shaft 324.

Wing actuating links 330 are formed from thin, non-elastic fabric or the like. A distal end 332 of wing actuating link 330 is knotted around wing support member 316 proximate bent portion 318. The proximal ends of wing actuating links 330 are each knotted around and secured to shaft 324 proximate bend 326 forming a main operating joint 334.

In operation, first cable 310 controls the movement of head portion 304 in a manner similar to that of head portion 104 of puppet 100 (FIG. 1) as described hereinabove. Second cable 320 provides control of the puppet's wings and tail, neither of which are shown. In-and-out motion of shaft 324 of cable 320 imparts up-and-down linear motion to main operating joint 334 which, in turn, moves wing support members 316 through wing actuating links 330. However, rotary motion imparted to shaft 324 within cable 320 causes rotation of loop 328 and the proximal end thereof which, in turn, imparts wagging (i.e., back and forth movement) of the puppet's tail, not shown.

Since other modifications and changes varied to fit a particular operating requirements and environment will be apparent to those skilled in the art, the invention is not considered limited to the example chosen for purposes of disclosure, and covers all changes and modifications which do not constitute a departure from the true spirit and scope of the invention.

Having thus described the invention, what is desired to be protected by Letters Patent is presented in the subsequent appended claims.

What is claimed is:

1. A puppet, comprising:

a) a body portion;

b) a first cable having a first outer sheath rigidly affixed to said first body portion and having a first shaft disposed substantially concentrically therein, said first shaft being adapted for movement relative to said first sheath;

c) a head portion rigidly affixed to said first shaft;

d) a second cable having an second outer sheath rigidly affixed to said first body portion and having a second shaft disposed substantially concentrically therein, said second shaft being adapted for movement relative to said second sheath; and e) means for supporting a wing flexibly affixed to said body portion and operatively connected to a proximal end of said second shaft;

whereby movement of said first shaft imparts motion to said head portion relative to said body portion, and movement of said second shaft imparts motion to said means for supporting a wing.

2. The puppet as recited in claim 1, wherein said motion of at least one of said first shaft and said second shaft comprises at least one of: rotary motion, and longitudinal motion.

3. The puppet as recited in claim 1, further comprising:

f) at least one of a first actuator disposed at a distal end of said first shaft, and a second actuator disposed at a distal end of said second shaft.

4. The puppet of claim 3, wherein at least one of said first actuator and said second actuator comprises a cable button.

5. The puppet of claim 1, wherein said head portion comprises an upper head portion and a lower jaw portion hingedly affixed thereto.

6. The puppet as recited in claim 5, further comprising:

f) a rigid support member disposed between said lower mouth portion and said body portion.

7. The puppet as recited in claim 5, further comprising:

f) a flaccid restraining member disposed between said head portion and said body portion.

* * * * *